US008550841B2

(12) United States Patent
Nomura et al.

(10) Patent No.: US 8,550,841 B2
(45) Date of Patent: Oct. 8, 2013

(54) FLAT CABLE CONNECTOR HAVING CABLE SUPPORT STRUCTURE

(75) Inventors: Shoichi Nomura, Kosai (JP); Goro Nakamura, Kosai (JP)

(73) Assignee: Yazaki Corporation, Tokyo (JP)

( * ) Notice: Subject to any disclaimer, the term of this patent is extended or adjusted under 35 U.S.C. 154(b) by 137 days.

(21) Appl. No.: 13/263,245

(22) PCT Filed: Apr. 14, 2010

(86) PCT No.: PCT/JP2010/056709

§ 371 (c)(1),
(2), (4) Date: Oct. 6, 2011

(87) PCT Pub. No.: WO2010/119905

PCT Pub. Date: Oct. 21, 2010

(65) Prior Publication Data

US 2012/0034815 A1 Feb. 9, 2012

(30) Foreign Application Priority Data

Apr. 15, 2009 (JP) ..... P2009-098717

(51) Int. Cl.
*H01R 3/00* (2006.01)

(52) U.S. Cl.
USPC ..... 439/495

(58) Field of Classification Search
USPC ..... 439/495, 492
See application file for complete search history.

(56) References Cited

U.S. PATENT DOCUMENTS

| | | | | | |
|---|---|---|---|---|---|
| 3,941,448 | A | * | 3/1976 | Evans | 439/493 |
| 4,109,986 | A | * | 8/1978 | Mouissie | 439/637 |
| 4,824,383 | A | * | 4/1989 | Lemke | 439/108 |
| 4,893,001 | A | * | 1/1990 | Ohkubo et al. | 235/490 |
| 4,971,574 | A | * | 11/1990 | Garcia | 439/497 |
| 5,111,362 | A | * | 5/1992 | Flamm et al. | 361/736 |
| 5,169,324 | A | * | 12/1992 | Lemke et al. | 439/101 |
| 5,213,534 | A | * | 5/1993 | Gardner et al. | 439/495 |

(Continued)

FOREIGN PATENT DOCUMENTS

| | | | |
|---|---|---|---|
| EP | 1 439 611 | A1 | 7/2004 |
| EP | 1 487 061 | A1 | 12/2004 |

(Continued)

OTHER PUBLICATIONS

International Search Report for PCT/JP2010/056709 dated Jun. 1, 2010 [PCT/ISA/210].

(Continued)

*Primary Examiner* — Amy Cohen Johnson
*Assistant Examiner* — Vladimir Imas
(74) *Attorney, Agent, or Firm* — Sughrue Mion, PLLC

(57) ABSTRACT

A connector is provided in which the number of components required for connecting operation can be reduced, and the manufacturing cost and weight thereof can be reduced. A connector housing 11 has an opening portion 11A that accommodates a mating connector when the connector is engaged with the mating connector. The connector housing 11 supports a flat cable 40 so that one end of the flat cable where the conductors 41 are exposed by removing the insulating sheath is arranged at the opening portion 11A. At least one of the conductors 41 exposed at the one end of the flat cable 40 is brought into contact with a terminal of the mating connector when the connector is engaged with the mating connector.

6 Claims, 13 Drawing Sheets

(56) References Cited

U.S. PATENT DOCUMENTS

| | | | | |
|---|---|---|---|---|
| 5,240,430 | A * | 8/1993 | Soes | 439/260 |
| 5,295,863 | A * | 3/1994 | Cady | 439/578 |
| 5,466,162 | A * | 11/1995 | Schroepfer et al. | 439/79 |
| 5,476,393 | A * | 12/1995 | Narita | 439/495 |
| 5,597,326 | A * | 1/1997 | DeLessert et al. | 439/607.08 |
| RE35,508 | E * | 5/1997 | Lemke et al. | 439/101 |
| 5,800,186 | A * | 9/1998 | Ramirez et al. | 439/74 |
| 5,944,553 | A * | 8/1999 | Yasui et al. | 439/495 |
| 5,964,620 | A * | 10/1999 | Takahashi et al. | 439/579 |
| 5,967,785 | A | 10/1999 | Maeda et al. | |
| 6,139,363 | A * | 10/2000 | Ko et al. | 439/579 |
| 6,165,007 | A * | 12/2000 | Higuchi et al. | 439/492 |
| 6,206,722 | B1 * | 3/2001 | Ko et al. | 439/417 |
| 6,213,810 | B1 * | 4/2001 | Okano | 439/497 |
| 6,217,344 | B1 * | 4/2001 | Saito et al. | 439/67 |
| 6,247,977 | B1 * | 6/2001 | Tanaka et al. | 439/874 |
| 6,264,500 | B1 * | 7/2001 | Kawabe | 439/496 |
| 6,341,966 | B1 * | 1/2002 | Takada et al. | 439/108 |
| 6,394,839 | B2 * | 5/2002 | Reed | 439/497 |
| 6,428,344 | B1 * | 8/2002 | Reed | 439/455 |
| 6,475,024 | B1 * | 11/2002 | Narui | 439/495 |
| 6,477,059 | B1 * | 11/2002 | Ono et al. | 361/785 |
| 6,529,113 | B2 * | 3/2003 | Endo et al. | 337/198 |
| 6,586,681 | B2 * | 7/2003 | Adams et al. | 174/117 F |
| 6,592,383 | B2 * | 7/2003 | Akram et al. | 439/131 |
| 6,604,966 | B1 * | 8/2003 | Hayes et al. | 439/752 |
| 6,638,090 | B2 * | 10/2003 | Wakata | 439/271 |
| 6,659,794 | B2 * | 12/2003 | Yamatani et al. | 439/495 |
| 6,695,642 | B2 * | 2/2004 | Shindo et al. | 439/495 |
| 6,773,288 | B2 * | 8/2004 | Geltsch et al. | 439/329 |
| 6,780,046 | B2 * | 8/2004 | Bach et al. | 439/495 |
| 6,854,995 | B2 * | 2/2005 | Hotea | 439/260 |
| 6,863,542 | B2 * | 3/2005 | Miyashita | 439/74 |
| 7,001,213 | B2 * | 2/2006 | Kaneko et al. | 439/579 |
| 7,021,958 | B2 * | 4/2006 | Shindo et al. | 439/409 |
| 7,035,126 | B1 * | 4/2006 | Lanni | 363/142 |
| 7,048,573 | B2 * | 5/2006 | Masaki et al. | 439/492 |
| 7,309,237 | B2 * | 12/2007 | Kuo | 439/63 |
| 7,393,224 | B2 * | 7/2008 | Milan | 439/171 |
| 7,484,994 | B2 * | 2/2009 | Ko | 439/495 |
| 7,559,772 | B2 * | 7/2009 | Tsai | 439/67 |
| 7,942,695 | B1 * | 5/2011 | Lu | 439/578 |

FOREIGN PATENT DOCUMENTS

| | | | |
|---|---|---|---|
| EP | 1 737 074 | A2 | 12/2006 |
| GB | 2 353 645 | A | 2/2001 |
| JP | 09-330772 | A | 12/1997 |
| JP | 2005-259560 | A | 9/2005 |
| JP | 2007-214087 | A | 8/2007 |
| JP | 2007-265720 | A | 10/2007 |
| JP | 2007-287363 | A | 11/2007 |

OTHER PUBLICATIONS

Written Opinion for PCT/JP2010/056709 dated Jun. 1, 2010 [PCT/ISA/237].

Extended European Search Report dated Feb. 14, 2013 issued by the European Patent Office in corresponding European Patent Application No. 10764489.0.

* cited by examiner

FLAT CABLE CONNECTOR HAVING CABLE SUPPORT STRUCTURE

TECHNICAL FIELD

The present invention relates to a connector in which a flexible flat cable and a connector are integrally formed with each other.

BACKGROUND ART

The flexible flat cable (hereinafter referred to as "FFC") has a structure that a plurality of flat conductors are arranged and are collectively covered with an insulating sheath. Since the FFC has a surface flat shape, the FFC has advantages such as a small volume of a wiring space, a high freedom of wiring by freely bending, a good heat radiation property and the like. Therefore, the FFCs are widely used in transporting devices, electric devices, indoor wiring or the like.

Meanwhile, various kinds of connectors are developed in order to connect FFCs with each other or connect an FFC with another electric connection member (see, for example, Patent document 1). A connector 100 for an FFC shown in FIG. 13, includes a connector housing 110, a plurality of connection terminals 120 and a flat harness 130.

The connector housing 110 includes a terminal holding housing 110A and an outer housing 110B in which the terminal holding housing 110A is accommodated. In the above components, the terminal holding housing 110A is formed of a terminal holding housing body section 111 and an individual terminal holding retainer section 112 which are engaged with each other. They are engaged with each other so that a plurality of terminal housing chambers (not shown) and an individual terminal support section (not shown) which supports a terminal section of a flat harness 130 are formed.

In addition, the terminal section of the flat harness 130 is firmly fixed to the terminal holding housing 110A. By accommodating the terminal holding housing 110A in a terminal holding housing chamber 113 of the outer housing 110B, the connector housing 110 is formed.

As shown in FIG. 14, a connection conductor 200 which is to be connected to flat conductors 320 of a flat cable under a condition that a window is formed on a part of an insulating sheath, is developed (see, for example, Patent Document 2).

In a connection method of the connection conductor 200, terminals 400 are arranged on at least one face 300A of the flat cable 300. The flat cable 300 and the terminal 400 are simultaneously sheared at least one portion so as to form each cut-and-raised part 301. The cut-and-raised part 301 continuously connected to an original base material at least one portion. Next, the flat cable 300 and the terminals 400 at the cut-and-raised parts 301 are pressed and crushed in the thickness direction thereof so as to expand them in a shear face direction and the original cut-and-raised parts 301 are press-fitted into respective holes again to allow the holes to be backfilled therewith to the middle thereof.

PRIOR ART DOCUMENTS

Patent Documents

Patent Document 1: JP-A-2005-259560

Patent Document 2: JP-A-2007-265720

SUMMARY OF INVENTION

Problems that the Invention is to Solve

In such a method, since connection of an FFC cable requires many working processes and components, the working requires time and labor and the cost is increased.

The invention is made in view of the above circumstances, and the purpose of the invention is to provide a connector of which the number of components required for connecting operation can be reduced, and the manufacturing cost and the weight thereof can be reduced.

Means for Solving the Problems

To achieve the above purpose, a connector according to the invention has characteristics of the following items (1) to (6).

(1) A connector according to the invention, there is provided a connector comprising:

a flat cable in which a plurality of conductors are arranged on a plane and peripheries of the conductors are covered with an insulating sheath: and a connector housing that supports the flat cable, wherein the connector housing has an opening portion which accommodates a mating connector when the mating connector is engaged with the connector and supports the flat cable so that one end of the flat cable where the conductors are exposed by removing the insulating sheath is arranged at the opening portion; and wherein at least one of the conductors exposed at the one end of the flat cable is brought into contact with a terminal of the mating connector when the mating connector is engaged with the connector.

(2) In the connector according to the item (1), the connector housing supports the flat cable so as to sandwich and hold, in thickness direction of the flat cable, any portion of the flat cable other than a portion where the conductors at the one end of the flat cable are exposed.

(3) In the connector according to the item (2), the connector housing supports the flat cable so as to sandwich and hold, in the thickness direction of the flat cable, any portion at the one end of the flat cable other than a portion where the conductors at the one end of the flat cable are exposed.

(4) In the connector according to the item (3), the connector housing supports the flat cable so as to sandwich and hold, in the thickness direction of the flat cable, the insulating sheath positioned between adjacent conductors exposed at the one end of the flat cable.

(5) In the connector according to the item (3), ribs are formed in the opening portion of the connector housing, the ribs sandwich and hold, in the thickness direction of the flat cable. The insulating sheath positioned between adjacent conductors exposed at one end of the flat cable and are extended toward the insulating sheath from an upper face and a lower face of the opening portion. A terminal accommodation space arranged between the adjacent ribs can accommodate one terminal of the mating connector.

(6) There is provided a connector comprising:

a terminal; and a connector housing that supports the terminal, wherein when the connector is engaged with a mating connector, the terminal is brought into contact with at least one of a plurality of conductors supported by the mating connector, the conductors being exposed by removing insulating sheath at one end of a flat cable and being arranged in parallel with each other on a plane, and peripheries of the conductors being covered with an insulating sheath;

wherein the terminal includes;

a conductor accommodation space which accommodates the conductors exposed at the one end of the flat cable when the connector is engaged with the mating connector; and a sandwich portion which sandwiches and holds, in thickness direction of the flat cable, the exposed conductors positioned in the conductor accommodation space and has conductivity so as be electrically conducted with the conductors; and wherein the connector housing has a flat cable accommodation space which accommodates one end of the flat cable when the connector is engaged with the mating connector, and supports the terminal so that the conductors exposed at the one end of the flat cable is accommodated in the conductor accommodation space when the one end of the flat cable is accommodated in the flat cable accommodation space.

In accordance with the connector having the configuration of the item (1), since a terminal is not provided on the connector as a male connector, it is possible to reduce the number of components required for connecting the flat cable with another electric connection member, and to reduce the manufacturing cost and the weight thereof.

In accordance with the connector having the configuration of any one of the items (2) to (4), since the connector housing sandwiches and holds the flat cable in the vertical direction, it is possible to prevent bending of the conductor exposed at the one end of the flat cable due to contacting with a terminal of a mating connector. As a result, the conductor exposed at the one end of the flat cable can be surely brought into contact with the terminal of the mating connector. Meanwhile, the position of sandwiching and holding the flat cable can be determined without limitation as long as the position is other than a position where the conductor is exposed at the one end of the flat cable. However, the more the position approaches to one end side of the flat cable, the more markedly the bending of the conductor exposed at one end of the flat cable can be prevented.

In accordance with the connector having the configuration of the item (5), the bending of the conductor exposed at the one end of the flat cable can be markedly prevented. By accommodating one terminal of the mating connector to the terminal accommodation space, one terminal of the mating connector can be assigned to one conductor of the flat cable. Accordingly, two or more terminals of the mating connector are not contacted with one conductor of the flat cable.

In accordance with the connector having the configuration of the item (6), since a terminal is not provided on the connector as a male connector, it is possible to reduce the number of components required for connecting the flat cable to another electric connection member and to reduce the manufacturing cost and the weight thereof.

Advantage of the Invention

In accordance with the connector of the invention, since a connector that supports a flat cable does not have a terminal, it is possible to reduce the number of components required for connecting operation, and to reduce the manufacturing cost and the weight thereof.

Thus, the invention is briefly described above. Details of the invention will be further clarified by reading through a mode for carrying out the invention described below with reference to the accompanying drawings.

MODE FOR CARRYING OUT THE INVENTION

Figure 1:
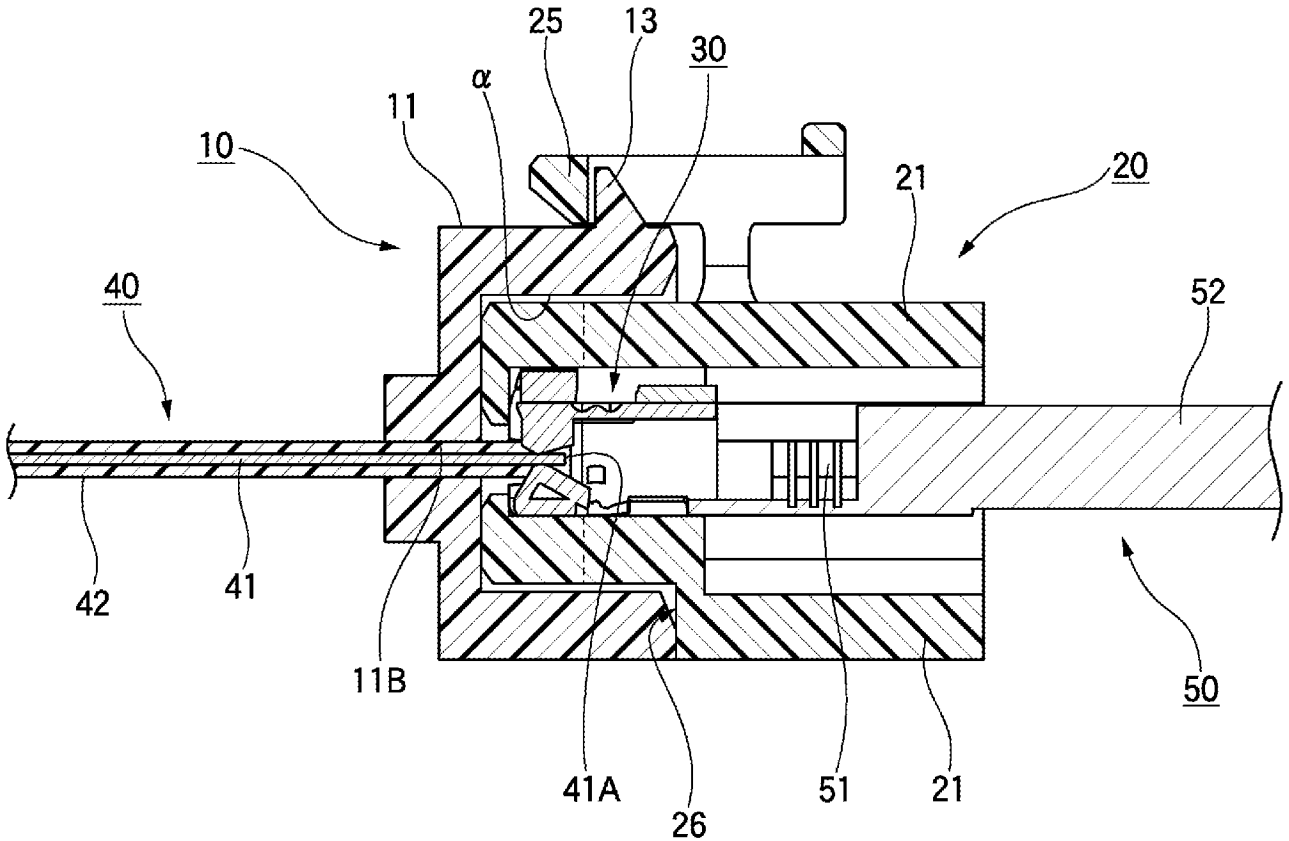
FIG. 1 is a cross sectional view showing a connector structure according to an embodiment of the invention.
Figure 2:
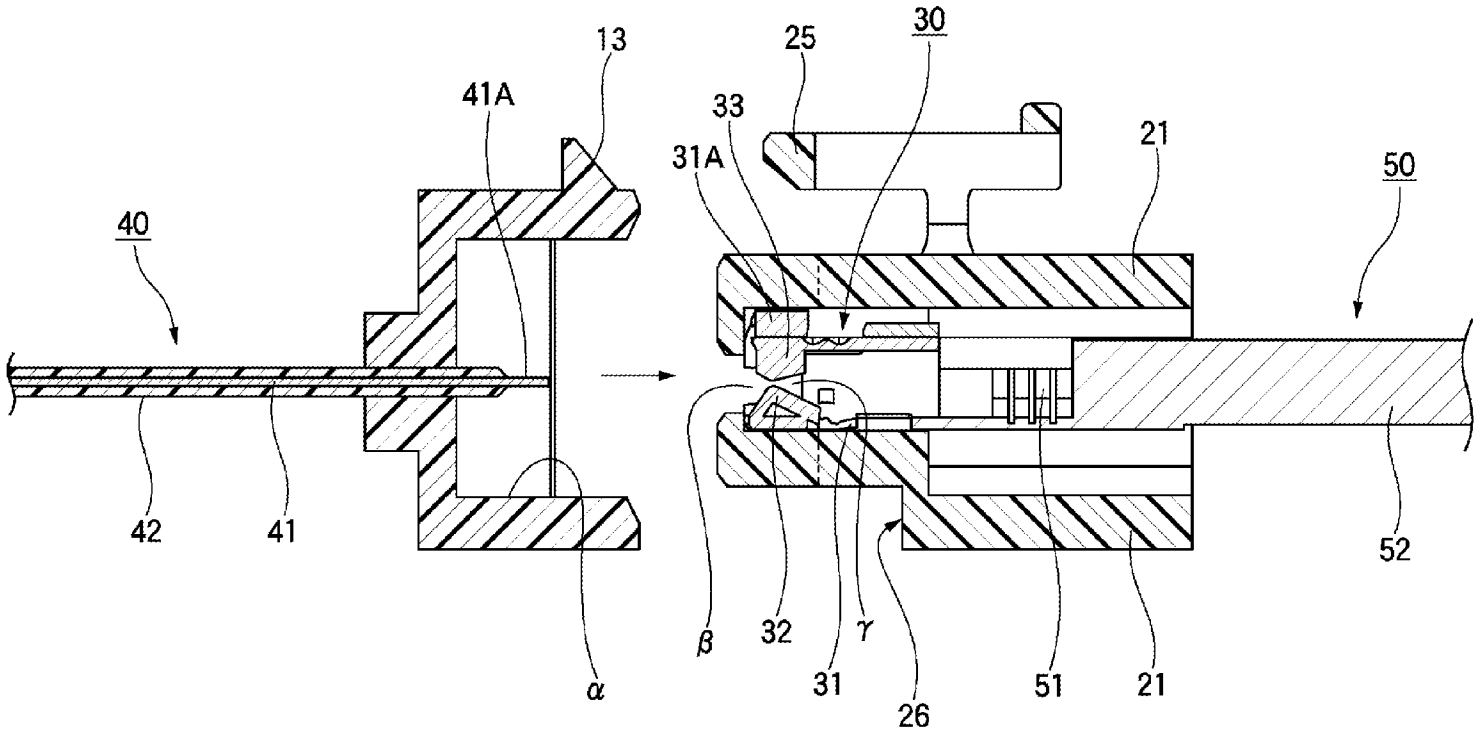
FIG. 2 is a cross sectional view showing each of connectors before engagement in the connector structure shown in FIG. 1.
Figure 3:
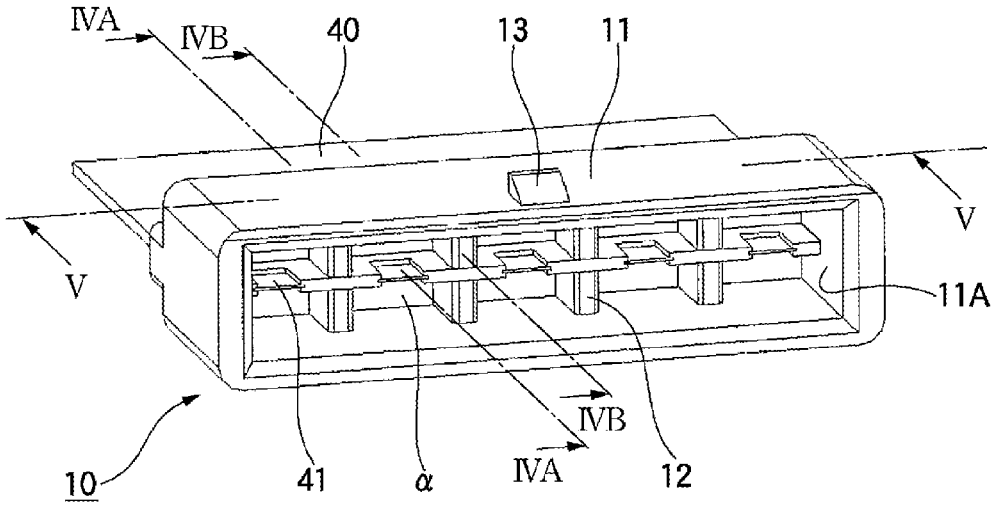
FIG. 3 is a perspective view showing a male connector used in the connector structure in FIG. 1.
Figure 4:
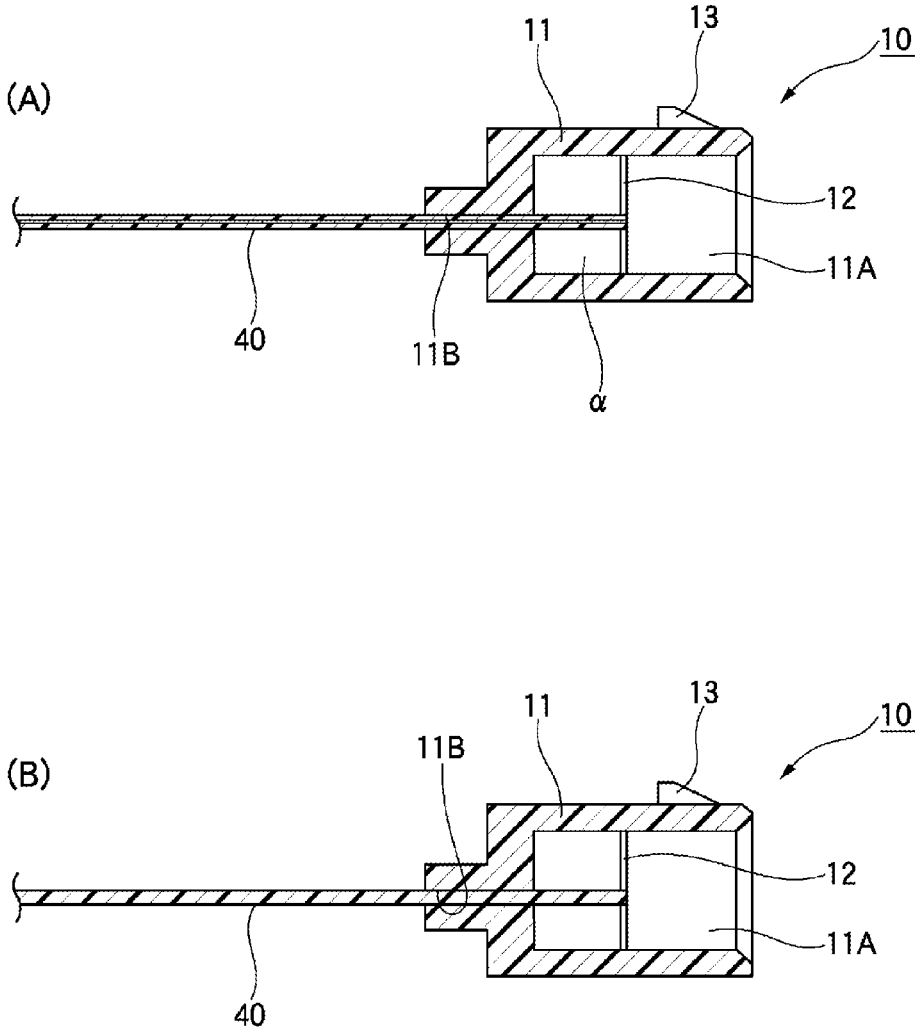
FIG. 4(A) is a cross section view from arrows taken along a line IVA-IVA in FIG. 3.
FIG. 4(B) is a cross sectional view from arrows taken along a line IVB-IVB in FIG. 3.
Figure 5:
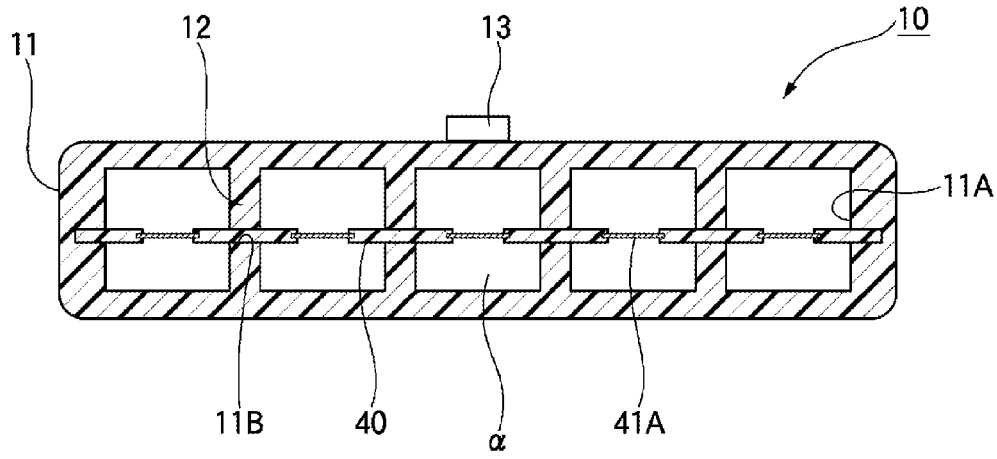
FIG. 5 is a cross sectional view from arrows taken along a line V-V in FIG. 3.
Figure 6:
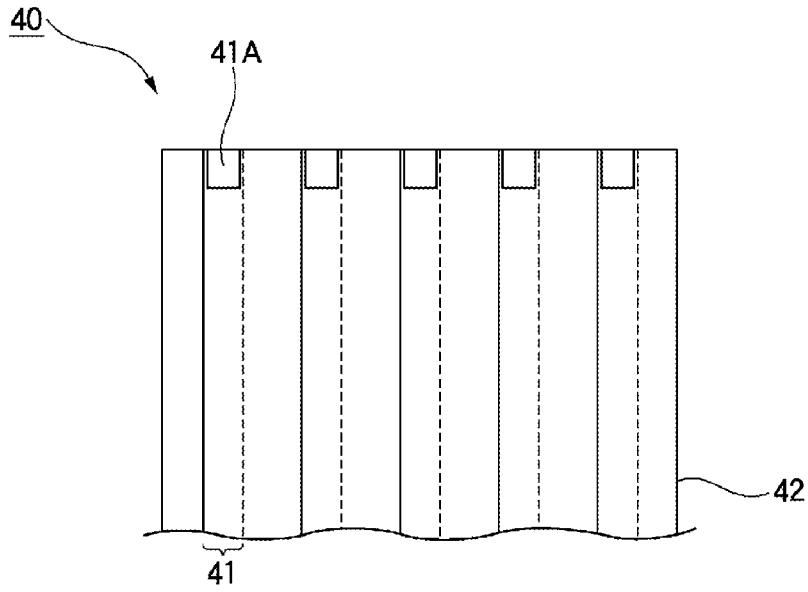
FIG. 6 is a plan view of a flat cable having an insulating sheath, a part of which is removed.
Figure 7:
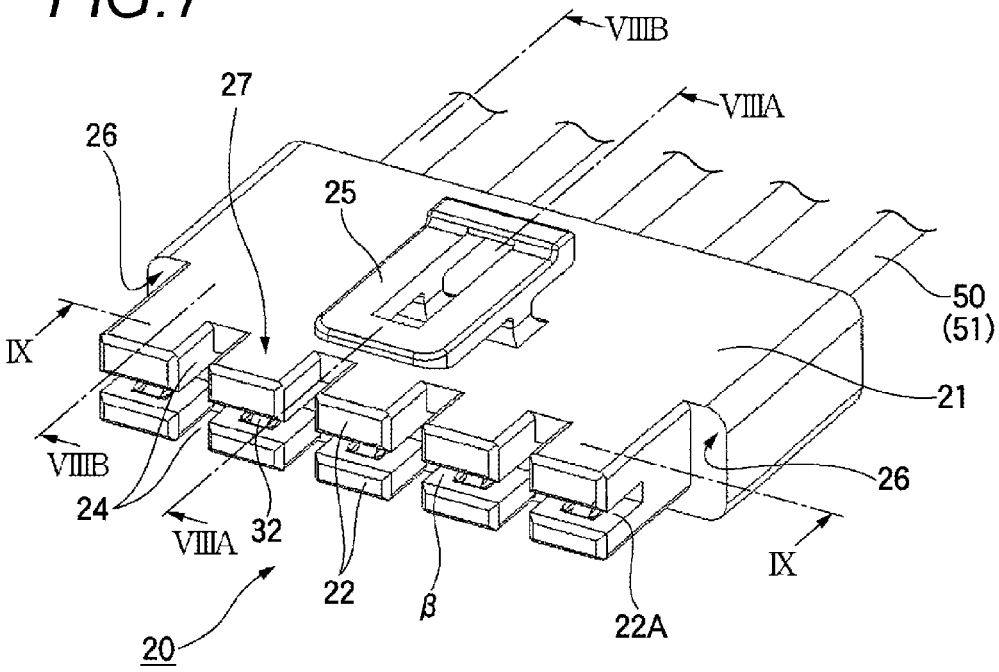
FIG. 7 is a perspective view showing a female connector used in the connector structure in FIG. 1.
Figure 8:
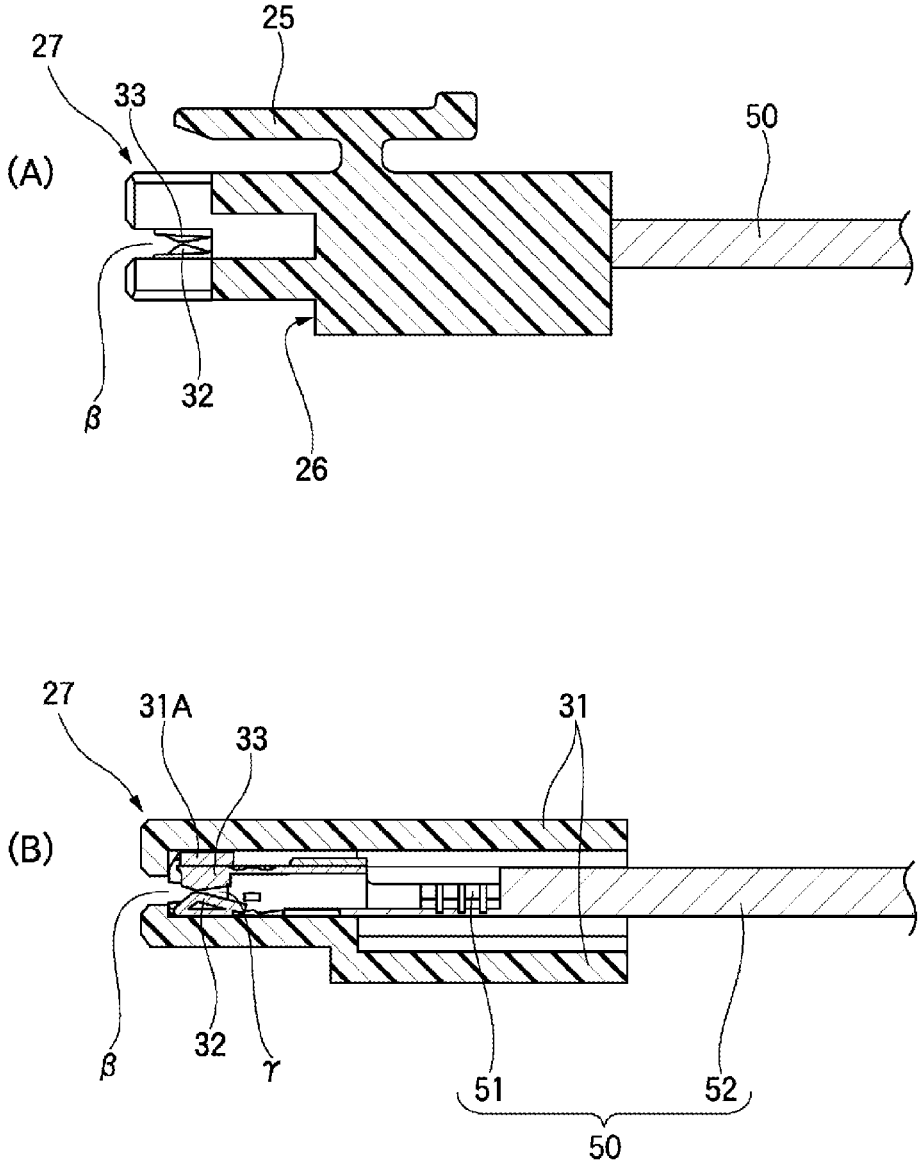
FIG. 8(A) is a cross sectional view from arrows taken along a line VIIIA-VIIIA in FIG. 7.
FIG. 8(B) is a cross sectional view from arrows taken along a line VIIIB-VIIIB in FIG. 7.
Figure 9:
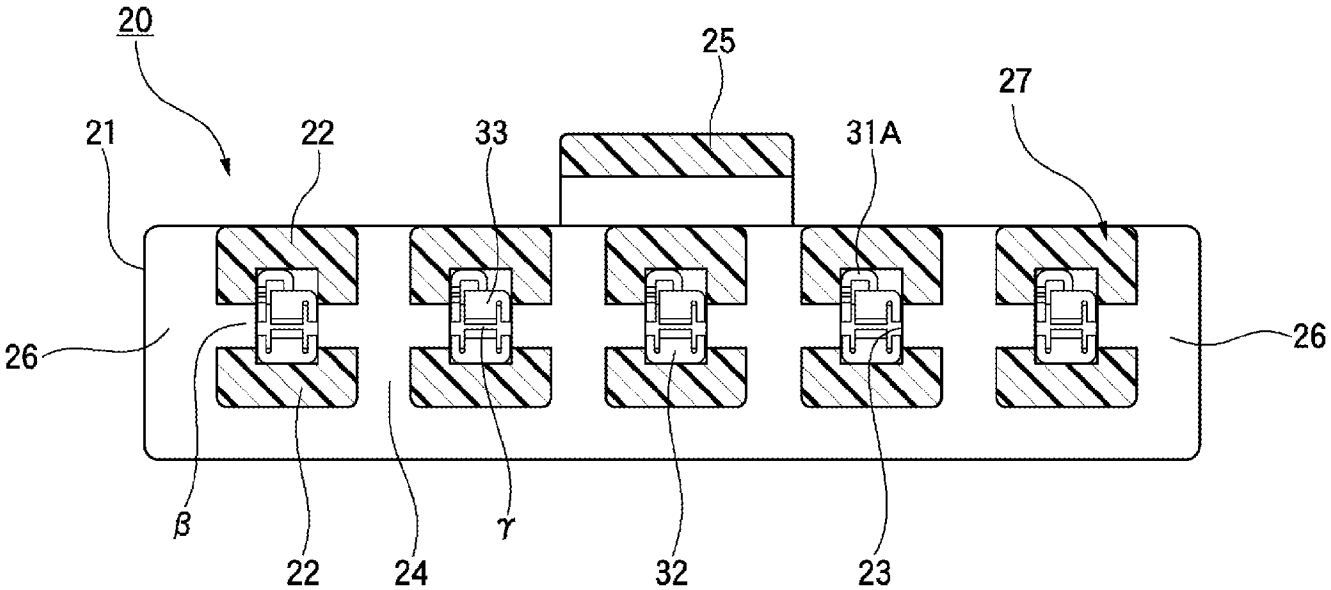
FIG. 9 is a cross sectional view from arrows taken along a line IX-IX in FIG. 7.
Figure 10:
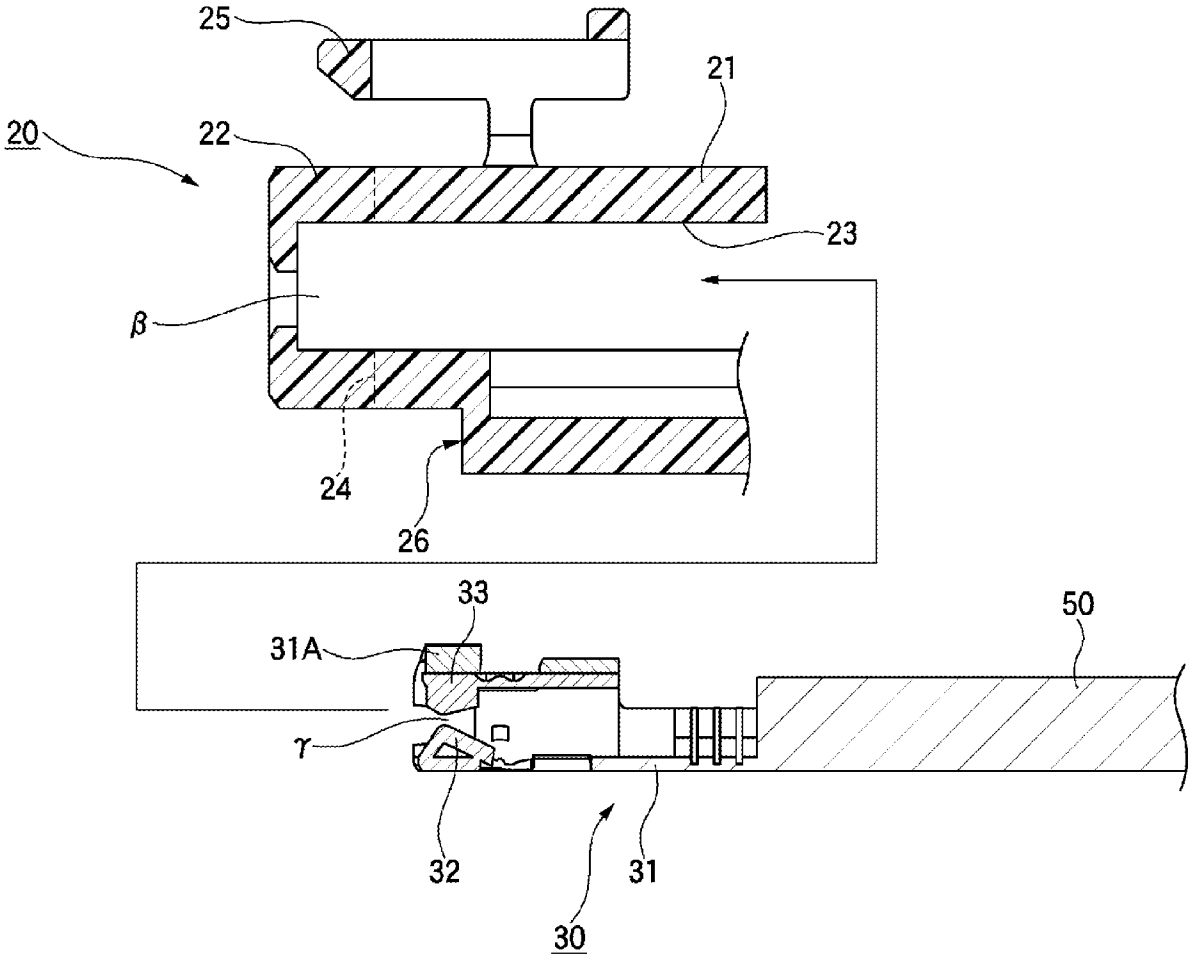
FIG. 10 is a cross sectional view showing the female connector shown in FIG. 7 under a condition that a female terminal is not yet attached thereto.
Figure 11:
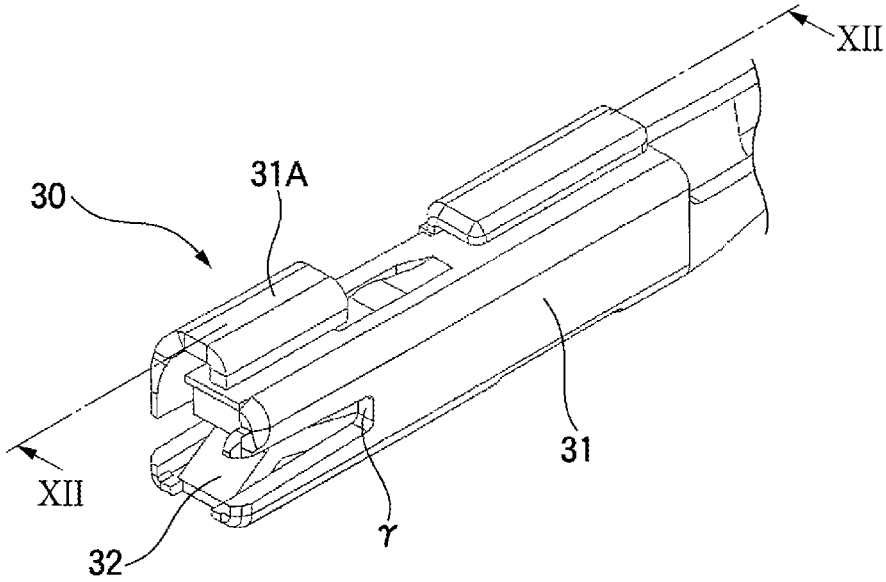
FIG. 11 is a perspective view showing the female terminal of the invention.
Figure 12:
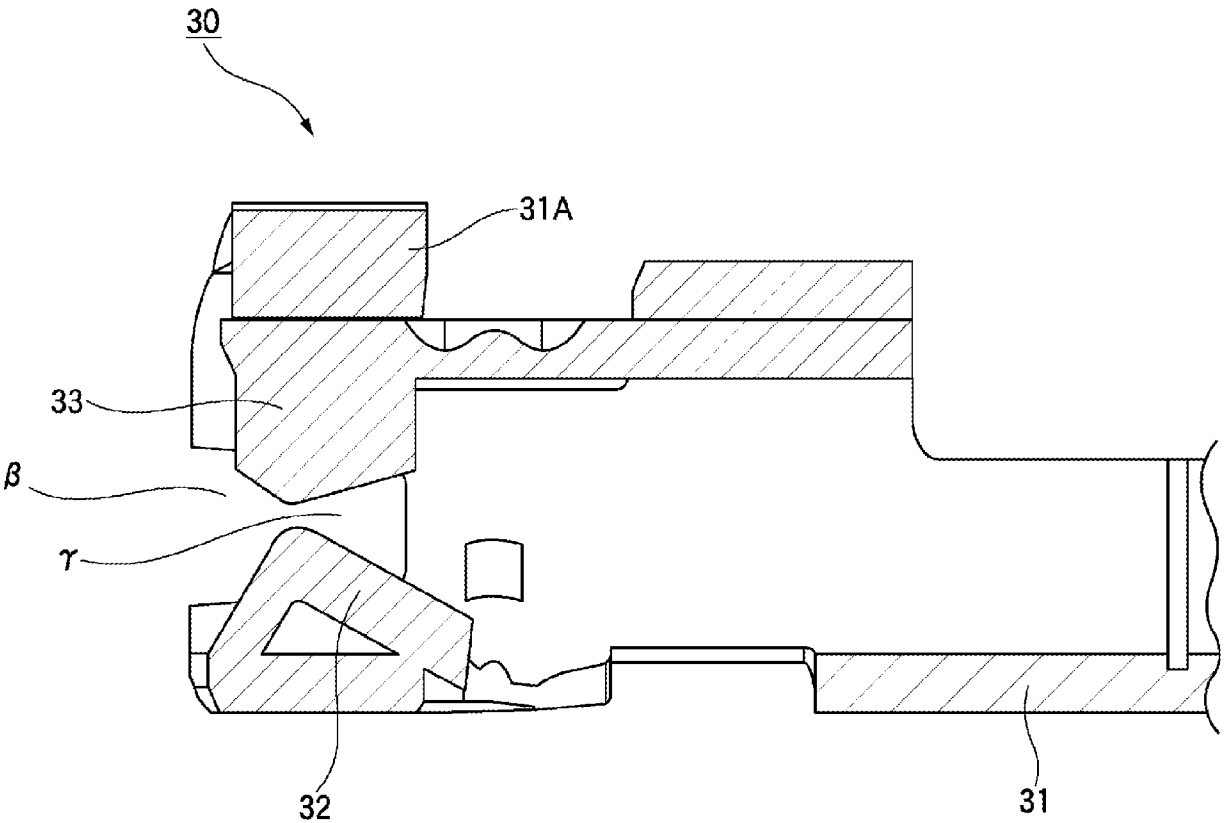
FIG. 12 is a cross sectional view from arrows taken along a line XII-XII in FIG. 11.
Figure 13:
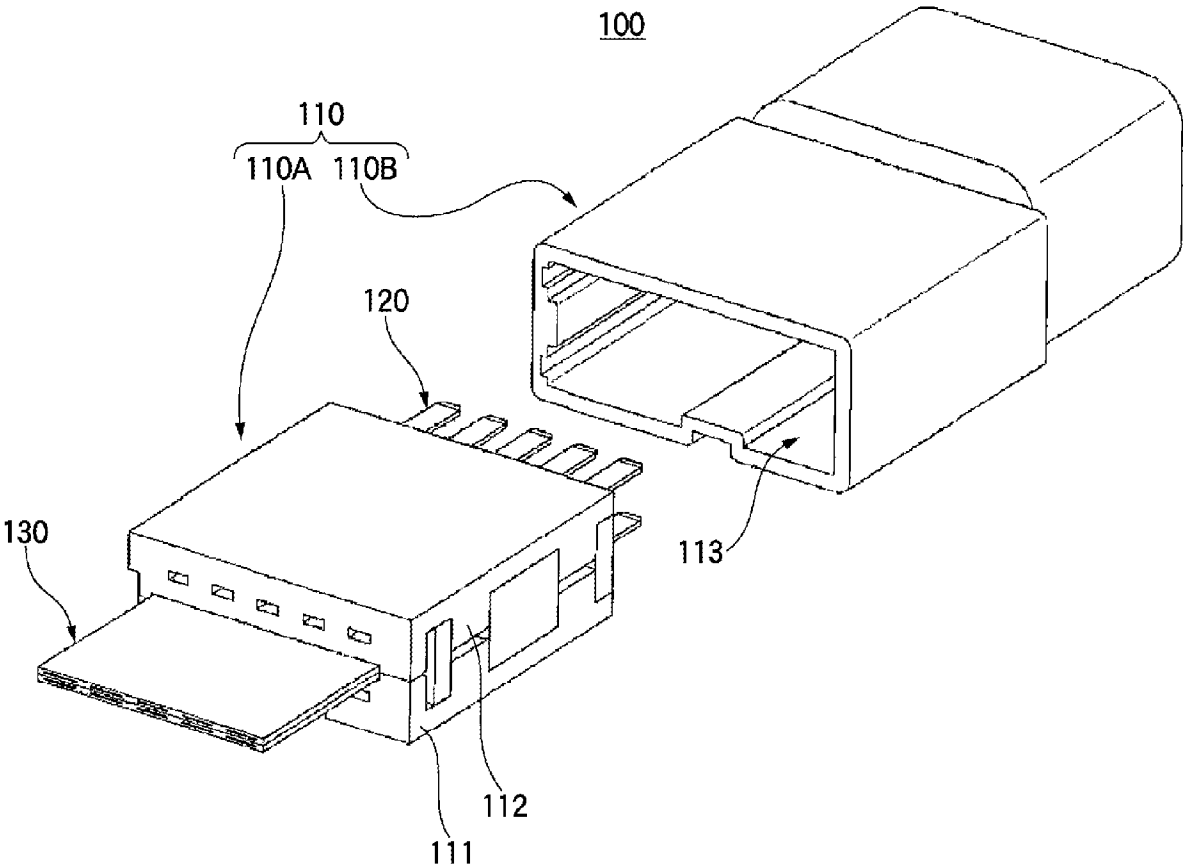
FIG. 13 is a perspective view showing a conventional connector structure.
Figure 14:
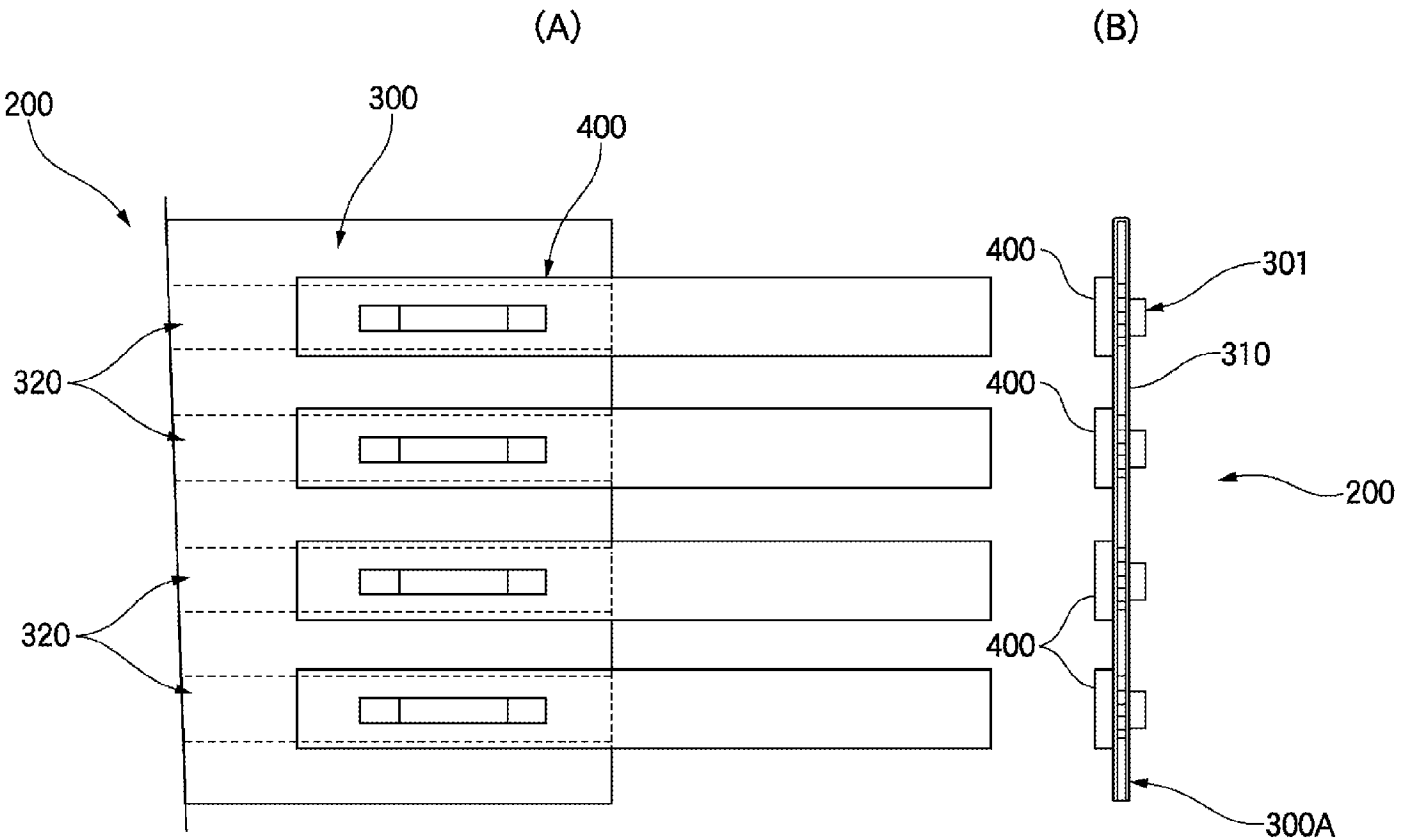
FIG. 14(A) is an explanatory view showing another conventional connector structure.
FIG. 14(B) is a side view thereof.

A preferable embodiment according to the invention is described below in detail with reference to the accompanying drawings. FIG. 1 is a cross sectional view showing a connector structure according to the embodiment of the invention. FIG. 2 is a cross sectional view showing each of connectors before fitting in the connector structure in FIG. 1. FIG. 3 is a perspective view showing a male connector used in the connector structure in FIG. 1. In FIG. 4, FIG. 4(A) is a cross sectional view from arrows taken along a line IVA-IVA in FIG. 3, and FIG. 4(B) is a cross sectional view from arrows taken along a line IVB-IVB in FIG. 3. FIG. 5 is a cross sectional view from arrows taken along a line V-V in FIG. 3. FIG. 6 is a plan view of a flat cable having an insulating sheath, a part of which is removed. FIG. 7 is a perspective view showing a female connector used in the connector structure in FIG. 1. In FIG. 8, FIG. 8(A) is a cross sectional view from arrows taken along a line VIIIA-VIIIA in FIG. 7, and FIG. 8(B) is a cross sectional view from arrows taken along a line VIIIB-VIIIB in FIG. 7. FIG. 9 is a cross sectional view from arrows taken along a line IX-IX in FIG. 7. FIG. 10 is a cross sectional view showing the female connector in FIG. 7 under a condition that a female terminal is not yet attached thereto. FIG. 11 is a perspective view showing the female terminal of the invention. FIG. 12 is a cross sectional view from arrows taken along a line XII-XII in FIG. 11. FIG. 13 is a perspective view showing a conventional connector structure. In FIG. 14, FIG. 14(A) is an explanatory view showing another conventional connector structure, and FIG. 14(B) is a side view thereof.

FIGS. 1 and 2 show a connector structure according to the invention, that has a male connector 10, a female connector 20, a female terminal 30 and a flat cable 40.

As shown in FIG. 3, the male connector 10 is formed as an outer connector with respect to the female connector 20 formed as an inner connector. As shown in FIGS. 4 and 5, in the male connector 10, a tip portion (a side where an exposed conductor 41A described later is positioned) of the flat cable 40 is supported by a connector housing 11 described later. A part of the flat cable 40 other than the tip portion is drawn to the outside from an end portion of the connector housing 11 at an opposite side of an opening portion 11A described later.

Meanwhile, as shown in FIG. 6, the flat cable 40 of the embodiment has a plurality (5 poles in the embodiment) of flat plate conductors 41 and an insulating sheath 42 which is made of an appropriate resin and covers peripheries of the conductors 41 juxtaposed on a plane. At one end of the flat cable 40 of the embodiment, a tip portion of the insulating sheath 42 is removed so as to expose the conductor therein (hereinafter, referred to as "the exposed conductor 41A").

The connector housing 11 is formed of an appropriate insulative resin material and has, at a tip portion, the opening portion 11A which receives insertion of the female connector 20 as a mating connector and is opened in a roughly square shape. Ribs 12 that sandwich and hold, in a thickness direction of the flat cable 40, the insulating sheath 42 positioned between the exposed conductors 41A are formed in the opening portion 11A of the connector housing 11. The ribs 12 are formed so as to be extended toward the insulating sheath 42 from an upper face and a lower face of the opening portion 11A. Therefore, the ribs 12 are divided into upper side ribs and lower side ribs with the flat cable 40 therebetween. The ribs 12 sandwich and hold the tip portion of the flat cable 40 so that the connector housing 11 supports the flat cable 40. Further, when the plurality of ribs 12 are formed and the opening portion 11A is demarcated into spaces of which the number is the same as the number of exposed conductors 41A, thereby a terminal accommodation space α can be formed in the opening portion 11A by each of the conductors 41. As a result, the exposed conductors 41A are arranged so as to face the respective terminal accommodation spaces α. A projection 13 for locking is formed on the connector housing 11 at a central part of the upper face in order to hold an engaged state with the female connector 20.

On the other hand, as shown in FIG. 7, the female connector 20 is formed as the inner connector with respect to the male connector 10 formed as the outer connector. When the male connector 20 is inserted into the opening portion 11A of the male connector 10, the male connector 10 and the female connector 20 are engaged with each other. In addition, by engaging the female connector 20 with the male connector 10, the female terminal 30 is brought into contact with the exposed conductor 41A at the tip portion of the flat cable 40 attached to the male connector 10. As shown in FIGS. 7 to 10, the female connector 20 according to the embodiment, includes the plurality (5 pieces in this embodiment) of female connectors 30 respectively connected to tip portions of electric wires 50 and a connector housing 21 that supports the female terminals 30 in a detachable condition.

As shown in FIG. 10, the connector housing 21 includes a projected portion 22 provided on a tip portion at a forward side (the left side in FIG. 10) in an engaging direction to the male connector 10, a female terminal chamber 23 that has a cavity formed in an area from the projected portion 22 positioned at the tip portion to a rear end portion at a rear side (the right side in FIG. 10) in the engaging direction and accommodates the female terminal 30 in the cavity, an engagement lock section 25 provided on the upper face, and a stop face 26 on which positioning in the event of bonding can be accurately performed by bringing a tip portion face of the connector housing 11 of the male connector 10 into contact with the stop face 26. In the connector housing 21, as shown in FIGS. 7 and 9, a plurality of female terminal holding sections 27 each having a set of the projected portion 22 and the female terminal chamber 23 are formed. Each slit 24 is formed between the adjacent female terminal holding sections 27.

Each of the projected portions 22 is formed in a shape so as to be accommodated in each terminal accommodation space α when the male connector 10 as the mating connector and the female connector are engaged with each other (in other words, each of the slits 24 is formed in a shape so as to accommodate the rib 12). In addition, a space (a flat cable accommodation space) β is formed on each of the projection portions 22 at a roughly central portion in the vertical direction by cutting out it in the horizontal direction, and the flat cable accommodation space β is positioned so as to be sandwiched by the upper and lower faces of the female terminal chamber 23 (see FIGS. 7 and 10).

The female terminal 30 is inserted into the female terminal chamber 23, to which the female terminal 30 is to be accommodated, from a rear side in the engaging direction to be fixed to the female terminal chamber 23. The flat cable accommodation space β (see FIG. 8) is positioned at a front side of the female terminal chamber 23 in the engaging direction.

The slit 24 is a groove formed between the respective female terminal holding sections 27 and has a shape capable of accommodating the rib 12 of the male connector 10 (sometimes, referred to as a rib accommodation space).

The engagement lock section 25 is to be engaged with the projection 13 for locking provided on the upper face of the connector housing 11 at the central portion in order to hold an engaged state when the male connector 10 as the mating connector is engaged therewith.

As shown in FIGS. 11 and 12, the female terminal 30 includes a thin long terminal body 31 having a roughly square pillar shape, a notch like conductor accommodation space γ provided at a tip portion of the terminal body 31 to which the exposed conductor 41A of the flat cable 40 is accommodated when the female connector 20 and the male connector 10 are engaged with each other, an arm 32 with a conductivity which is provided in the conductor accommodation space γ at the tip portion of the terminal body 31 so as to sandwich, in the thickness direction, the exposed conductor 41A positioned in the conductor accommodation space γ and to be conducted with the exposed conductor 41A when the female connector 20 and the male connector 10 are engaged with each other, and a pressure contact projection 33 which has a flexibility and a conductivity and is provided to be projected in opposition to the arm 32 in the conductor accommodation space γ at the tip portion of the terminal body 31 similarly to the above. The arm 32 and the pressure contact projection 33 can be collectively referred to as a sandwiching/holding section. The conductor accommodation space γ is a space where the exposed conductor 41A at one end side of the flat cable 40 is to be accommodated similarly to the flat cable accommodation space β and the conductor accommodation space γ is included in the inner space of the flat cable accommodation space β. Therefore, the connector housing 21 is to support the female terminal 30 in such a manner that the exposed conductor 41A exposed at one end of the flat cable 40 is accommodated in the conductor accommodation space γ when the one end of the flat cable 40 is accommodated in the flat cable accommodation space β.

The terminal body 31 is formed of a metallic material. The terminal body 31 is inserted into the female terminal chamber 23 so as to be fixed to the female terminal chamber 23. Therefore, as shown in FIG. 11, the tip portion of the terminal body 31 has a projected portion 31A with a cantilever structure holding an elasticity so as to be in press contact with a ceiling face in the female terminal chamber 23.

The arm 32 is formed roughly in a L shape in a cross section so as to be surely contacted and conducted with the exposed conductor 41A. As described above, by engaging the connector with the male connector 10 as the mating connector, the arm 32 of the embodiment sandwiches the exposed conductor 41A at the tip portion of the flat cable 40 attached to the male connector 10 at a portion between the arm 32 and the pressure contact projection 33 in the vertical direction by an elastic force so that the exposed conductor 41A and the female terminal 30 are contacted and conducted with each other so that they are electrically connected with each other.

As described above, an electric wire 50 having a structure which is commonly and widely used, is used. To be specific, as shown in FIG. 8, the wire 50 has a conductor 51 formed by stranding a plurality of filament like wire materials (core wires) and an insulating sheath 52 formed at a periphery of the conductor 51.

Next, a function of the embodiment is described below. In the male connector 10 of the embodiment, as shown in FIG. 3, the ribs 12 are formed on the opening portion 11A of the connector housing 11. Therefore, the terminal accommodation spaces α demarcated by the ribs 12 are formed in the opening portion 11A of the connector housing 11. The exposed conductors 41A are respectively arranged in the respective terminal accommodation spaces α so as to face the terminal accommodation spaces α.

On the other hand, the female terminal holding sections 27 are formed in the connector housing 21 of the female connector 20 and the female terminals 30 are attached to the respective female terminal chambers 23 so that the female terminals 30 are accommodated in the respective terminal accommodation spaces α when the male connector 10 and the female connector 20 are engaged with each other. As shown in FIGS. 2 and 10, the flat cable accommodation space β is formed at a tip portion in the connector housing 21 of the female connector 20. In addition, the female terminal 30 is attached to the female terminal chamber 23 so as to allow the conductor accommodation space γ to be included in the flat cable accommodation space β.

When the male connector 10 is engaged with the female connector 20, the female terminal holding sections 27 of the connector housing 21 of the female connector 20 enter the respective terminal accommodation spaces a having the exposed conductors 41A arranged therein, as shown in FIG. 1. Since one female terminal holding section 27 is accommodated in the respective terminal accommodation space α, the female terminals 30 can be respectively assigned to the conductors 41 of the flat cable 40. Consequently, the plurality of female terminals 30 are not contacted with one conductor 41 of the flat cable 40.

Therefore, when the male connector 10 is engaged with the female connector 20, the exposed conductor 41A passes through the flat cable accommodation space β at a connector housing 21 side and advances to the conductor accommodation space γ at a female terminal 30 side. Here, the arm 32 and the pressure contact projection 33 are provided in the conductor accommodation space γ at the female terminal 30 side. The exposed conductor 41A is sandwiched between the arm 32 and the pressure contact projection 33 by the elastic force in the vertical direction so that the exposed conductor 41A and the female terminal 30 are contacted and conducted with each other, thereby they are electrically connected with each other.

Next, an example of fixing the flat cable 40 to the male connector 10 of the embodiment, is described below. Here, a pass-through space 11B for causing the flat cable 40 to be inserted thereinto, is formed on the connector housing 11 of the male connector 10 at an end portion opposite to the opening portion 11A (see FIGS. 4 and 5). The pass-through space 11B reaches the ribs 12. Thereby, the flat cable 40 at the tip portion side having the exposed conductors 41A formed thereon is inserted into the pass-through space 11B of the connector housing 11. Accordingly, the flat cable 40 inserted into the pass-through space 11B can be sandwiched and held by the upper side and lower side ribs.

In addition, another example of fixing the flat cable 40 to the male connector 10 of the embodiment is described below. Here, the connector housing 11 of the male connector 10 is formed in a shape so as to be dividable into the upper housing having the upper side ribs and the lower housing having the lower side ribs. Thereby, the flat cable 40 is sandwiched by the upper and lower housing in the vertical direction of the flat cable 40 so that the flat cable 40 is sandwiched and held.

In addition, further another example of fixing the flat cable 40 to the male connector 10 of the embodiment is described below. Here, regarding the flat cable 40, the insulating sheath 42 is peeled from the tip portion so as to form the exposed conductors 41A, in advance. The tip portion of the flat cable 40 is set on a predetermined position in a cavity of a metallic mold, and then a resin is injected so that they are collectively subjected to insert molding. Thus, while various methods of fixing the flat cable 40 to the connector housing 11 of the male connector 10 can be considered, an important point of the invention is that the flat cable 40 is fixed to the connector housing 11 in such a manner that one end of the flat cable 40 where the insulating sheath 42 is removed and the conductors 41 are exposed, faces the opening portion 11A.

In accordance with the connector according to the embodiment of the invention, since terminals are not provided on the male connector 10, it is possible to reduce the number of components required for connecting the flat cable 40 with another electric connection member and to reduce the manufacturing cost and the weight thereof.

In addition, since the flat cable 40 is sandwiched and held by the connector housing 11 in the vertical direction, it is possible to prevent bending of the exposed conductor 41A exposed at one end of the flat cable 40 due to contacting with the female terminal 30. As a result, it is possible to surely bring the exposed conductors 41A exposed at one end of the flat cable 40 into contact with the respective female terminals 30. Meanwhile, the position of sandwiching and holding the flat cable 40 can be determined without limitation as long as the position is other than a position where the conductor 41 is exposed at one end of the flat cable 40. However, the more the position approaches to the one end side of the flat cable 40, the more markedly the bending of the conductor exposed at one end of the flat cable 40 can be prevented.

While the invention is described in detail by referring to the specific embodiments, it is understood by those of ordinary skill in the art that various modifications and changes can be made without departing from the sprit and scope of the invention.

This application is based on Japanese Patent Application (JP-2009-098717) filed on Apr. 15, 2009, the contents of which are incorporated herein by reference.

DESCRIPTION OF REFERENCE NUMERALS AND SIGNS

10 male connector
11 connector housing

11A opening portion
11B pass-through space
12 rib
13 projection for locking
20 female connector
21 connector housing
22 projected portion
23 female terminal chamber
24 slit (rib accommodation space)
25 engagement lock section
26 stop face
27 female terminal holding section
30 female terminal
31A projected portion
31 terminal body
32 arm
33 pressure contact projection
40 flat cable
41 conductor
41A exposed conductor
42 insulating sheath
50 electric wire
51 core wire (conductor)
52 insulating sheath
α terminal accommodation space
β flat cable accommodation space
γ conductor accommodation space

The invention claimed is:

1. A connector, comprising:

a flat cable in which a plurality of conductors are arranged on a plane and peripheries of the conductors are covered with an insulating sheath: and a connector housing that supports the flat cable, wherein the connector housing has an opening portion which accommodates a mating connector when the mating connector is engaged with the connector and supports the flat cable so that one end of the flat cable where the conductors are exposed by removing the insulating sheath is arranged at the opening portion; and wherein at least one of the conductors exposed at the one end of the flat cable is brought into contact with a terminal of the mating connector when the mating connector is engaged with the connector;

wherein opposing ribs are formed in the opening portion of the connector housing, wherein the opposing ribs are respectively provided above and below the flat cable so as to sandwich and hold, in a thickness direction of the flat cable, the insulating sheath of the flat cable and are extended toward the insulating sheath from an upper face and a lower face of the opening portion, and wherein a terminal accommodation space arranged between the adjacent ribs can accommodate one terminal of the mating connector.

2. The connector according to claim 1, wherein the connector housing supports the flat cable so as to sandwich and hold, in the thickness direction of the flat cable, any portion of the flat cable other than a portion where the conductors at the one end of the flat cable are exposed.

3. The connector according to claim 2, wherein the connector housing supports the flat cable so as to sandwich and hold, in the thickness direction of the flat cable, any portion at the one end of the flat cable other than a portion where the conductors at the one end of the flat cable are exposed.

4. The connector according to claim 3, wherein the connector housing supports the flat cable so as to sandwich and hold, in the thickness direction of the flat cable, the insulating sheath positioned between adjacent conductors exposed at the one end of the flat cable.

5. The connector according to claim 3, wherein the ribs sandwich and hold, in the thickness direction of the flat cable, the insulating sheath positioned between adjacent conductors exposed at one end of the flat cable.

6. A connector comprising:

a terminal; and a connector housing that supports the terminal, wherein when the connector is engaged with a mating connector, the terminal is brought into contact with at least one of a plurality of conductors supported by the mating connector, the conductors being exposed by removing insulating sheath at one end of a flat cable and being arranged in parallel with each other on a plane, and peripheries of the conductors being covered with an insulating sheath;

wherein the terminal includes;

a conductor accommodation space which accommodates the conductors exposed at the one end of the flat cable when the connector is engaged with the mating connector; and a sandwich portion which sandwiches and holds, in thickness direction of the flat cable, the exposed conductors positioned in the conductor accommodation space and has conductivity so as be electrically conducted with the conductors; and wherein the connector housing has a flat cable accommodation space which accommodates one end of the flat cable when the connector is engaged with the mating connector, and supports the terminal so that the conductors exposed at the one end of the flat cable is accommodated in the conductor accommodation space when the one end of the flat cable is accommodated in the flat cable accommodation space.

* * * * *